United States Patent [19]

Lombardo

[11] Patent Number: 4,911,354

[45] Date of Patent: Mar. 27, 1990

[54] BUSINESS FORM INCORPORATING FLIP WINDOW WITH CLEAR FILM PATCH

[75] Inventor: Leo Lombardo, Manchester, N.H.

[73] Assignee: Moore Business Forms, Grand Island, N.Y.

[21] Appl. No.: 329,386

[22] Filed: Mar. 27, 1989

[51] Int. Cl.[4] ..... B65D 27/10; B65D 27/04

[52] U.S. Cl. ..... 229/69; 229/71

[58] Field of Search ..... 229/69, 71, 92.3

[56] References Cited

U.S. PATENT DOCUMENTS

| | | | |
|---|---|---|---|
| 1,000,466 | 8/1911 | Watson | 229/92.3 |
| 1,438,122 | 12/1922 | McCoy . | |
| 2,158,233 | 5/1939 | Gray . | |
| 2,927,723 | 3/1960 | Johnson . | |
| 4,294,400 | 10/1981 | Gendron . | |
| 4,354,631 | 10/1982 | Stevenson . | |
| 4,382,539 | 5/1983 | Kronman . | |
| 4,487,360 | 12/1984 | Fisher et al. . | |
| 4,595,138 | 6/1986 | Kristel . | |
| 4,598,860 | 7/1986 | Pennock . | |
| 4,799,618 | 1/1989 | Jenkins | 229/71 |

FOREIGN PATENT DOCUMENTS

| | | | |
|---|---|---|---|
| 0161377 | 11/1920 | United Kingdom | 229/71 |
| 0186490 | 10/1922 | United Kingdom | 229/71 |

*Primary Examiner*—Stephen Marcus

*Attorney, Agent, or Firm*—Nixon & Vanderhye

[57] ABSTRACT

A continuous business form assembly comprises a continuous web incorporating a plurality of business forms, the business forms each having a window flap portion and a non-window, remainder portion, the form having an exterior surface and an opposite, interior surface. The window flap portion has a first face defined on the web exterior surface and a second face defined on the web interior surface, the window first face and second face thereby being defined on the opposite exterior and interior surfaces of the form. The window flap portion is partially cut from the form to thereby form a window at least partially defined by one edge providing a fold line about which the window flap portion is foldable to a printing position in which the window flap first face is exposed with the interior surface of the form, for simultaneous, printing of the window flap first face and the interior surface of the form. The window flap portion is foldable along the fold line, after printing, to a closed portion in which the window flap first face is returned to exposure with the exterior surface of the form and acts as a label for the business form. Each window is substantially covered by a transparent patch mounted to the interior surface of the form, the patch defined by four edges, a first of which is located substantially along the fold line of the window flap portion.

20 Claims, 2 Drawing Sheets

BUSINESS FORM INCORPORATING FLIP WINDOW WITH CLEAR FILM PATCH

BACKGROUND AND SUMMARY OF THE INVENTION

This invention relates to business forms in general, and to envelope mailers having die cut windows in particular.

Typically, envelope mailers are formed from continuous webs of paper, wherein successive envelope blanks are separated from each other by transverse lines of weakening. The blanks have die cut windows which allow information pre-printed on the blank, such as the recipient's name and address, to appear through the window.

Envelope mailers of this type are regarded as having only limited usefulness since the arrangement precludes the use of inserts which would otherwise block the window. Nevertheless, there are many die cut window mailers in the prior art. For example, in U.S. Pat. No. 1,438,122, a two-way envelope mailer is disclosed which includes a die cut window where three sides are cut and a fourth side forms a hinge about which a window flap may be pivoted between open and closed positions. In a send mode, the flap is folded upwardly against the front envelope panel so that the recipient's name and address appears through the window. In a return mode, the flap, which has its exterior surface printed with a return address, is turned downwardly to close the window and display the return address. This patent also discloses the use of a transparent patch applied to the interior surface of the front envelope panel, over the window area. However, this arrangement is not satisfactory since, when the flap is turned down in its return mode, the transparent patch interferes with the movement of the flap, and apparently requires the patch to be torn in at least two locations to permit the flap to lie flat against the patch in the closed or return mode.

In U.S. Pat. No. 2,927,723, a reply letter sheet is formed with a die cut window similar to that in the '122 patent described above. Here again, in the send mode, the window flap is turned upwardly so that the recipient's address is displayed through the window, while in a reply or return mode, the flap is turned downwardly to close the window and display the return address pre-printed on the exterior surface of the flap. In this patent, a transparent patch is applied to the outside surface of the front envelope panel. This arrangement is unsatisfactory in that the transparent patch edges are exposed and subject to peeling which, in turn, may cause damage to the envelope during further processing and/or mailing.

In U.S. Pat. No. 4,598,860, (assigned to the assignee of the present invention), a mailer with a die cut window is disclosed wherein the envelope blank and die cut window flap are printed in a single printing operation. More specifically, the window flap is folded upwardly against the adjacent interior surface of the front envelope panel so that both the interior surface of the panel and the exterior surface of the window flap may be printed together in a single step. Once printed, the window flap is closed to display the recipient address information on the now closed window flap. In order to maintain the flap closed, but also to preclude the possibility of the window flap being pushed through the window as it moves away from the printing position, an oversized paper patch is adhered to the back of the window flap and, after the window flap is closed, an adhesive strip surrounding the window opening is activated to seal the oversized patch to the front panel of the envelope. This envelope construction thus also accommodates insert webs, return envelopes, and the like without interfering with the display of the recipient address information. However, this construction has other problems associated with its production in that special heat sealable adhesive must be applied about the window edges to seal the oversized patch, and hence the window flap, to the envelope panel; specialized tooling is required to activate the adhesive; the oversized patch reduces the area available for printing; and a 100% inspection rate is required to insure the quality of the mailers.

The present invention relates to a mailer having a die cut window flap and a transparent patch, configured in a way as to eliminate many problems associated with prior art window-type mailers.

In the present invention, a business form is provided in the form of a mailer blank in which a three sided die cut forms a hinged window flap, but the oversized paper patch as disclosed in the '860 patent is eliminated. In its place, a clear film patch is applied over the window opening, on the interior surface of the front envelope panel. The location of the clear film patch is adjusted to preclude any interference with the movement of the window flap between open (or printing) and closed positions. Specifically, the clear film patch overlaps the three die cut edges of the window, but does not overlap the fourth or folding edge. Rather, the corresponding fourth edge of the clear film patch lies closely adjacent, and below, the fourth, or folding edge of the window flap. The clear film patch is easily applied to the interior surface of the front envelope panel by cold glue adhesive.

Thus, in one exemplary embodiment of the invention, a continuous business form assembly is provided which comprises a continuous web incorporating a plurality of business forms, each having a window flap portion and a non-window, or remainder portion. The form has an exterior surface and an interior surface, and the window flap portion has a first face defined on the web exterior surface, and a second face defined on the web interior surface.

The window flap portions are each partially cut from the form to thereby provide a window at least partially defined by one edge foldable along a fold line to a printing position in which the window flap first face is exposed with the interior surface of the form for simultaneous printing of the window flap first face and the interior surface of the form.

The window flap portion is foldable along the fold line, after printing, to a closed position in which the window flap first face is returned to exposure with the exterior surface of the form, and acts as a label for the business form.

Each window is substantially covered by a transparent (clear film) patch mounted to the interior surface of the form, the patch defined by four edges, a first of which is located substantially along the fold line.

It will therefore be appreciated that the present invention provides the following advantages over the '860 construction:

(a) The need for an oversized paper patch adhered to the window flap is eliminated;

(b) The need for hot melt resealable glue about three sides of the window opening as well as specialized tooling to activate the glue are eliminated;

(c) The need for 100% inspection is eliminated because the present construction assures a more reliable product;

(d) folding the window flap to its open or printing position is facilitated;

(e) Additional printing area is provided through elimination of the oversized, opaque paper patch;

(f) The utilization of the clear film patch rigidifies the front envelope panel, facilitating bursting of the form by the end user;

(g) The need to seal the window flap closed after printing is eliminated.

Additional objects and advantages of the present invention will become apparent from the detailed description which follows.

DETAILED DESCRIPTION OF THE DRAWINGS

Figure 1:
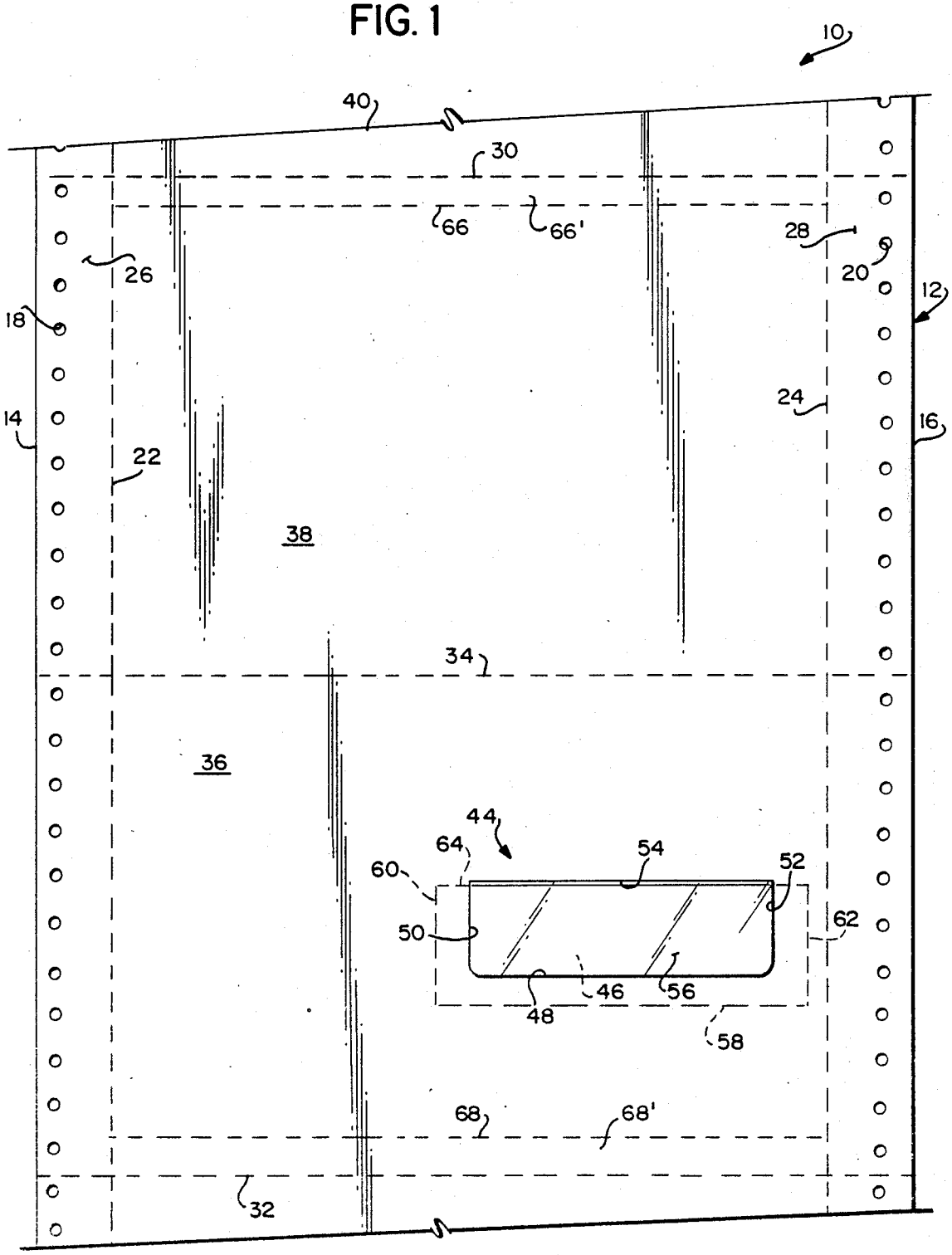
FIG. 1 is a partial plan view of a continuous web incorporating form blanks in accordance with the invention, and wherein a window flap is shown in the closed position.
Figure 2:
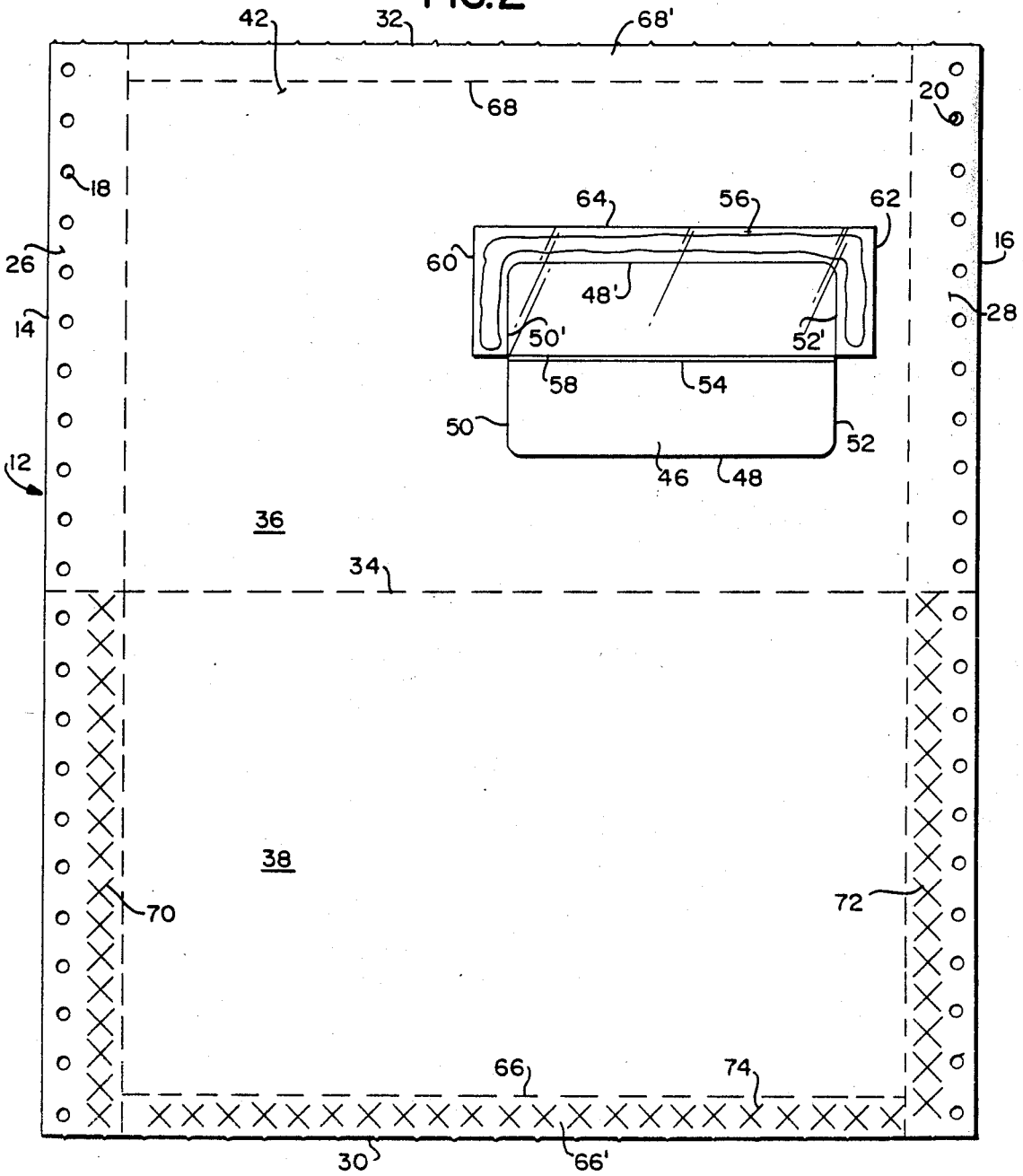
FIG. 2 is a bottom view of the continuous web shown in FIG. 1, but wherein the window flap is shown in an open or printing position.
Figure 3:
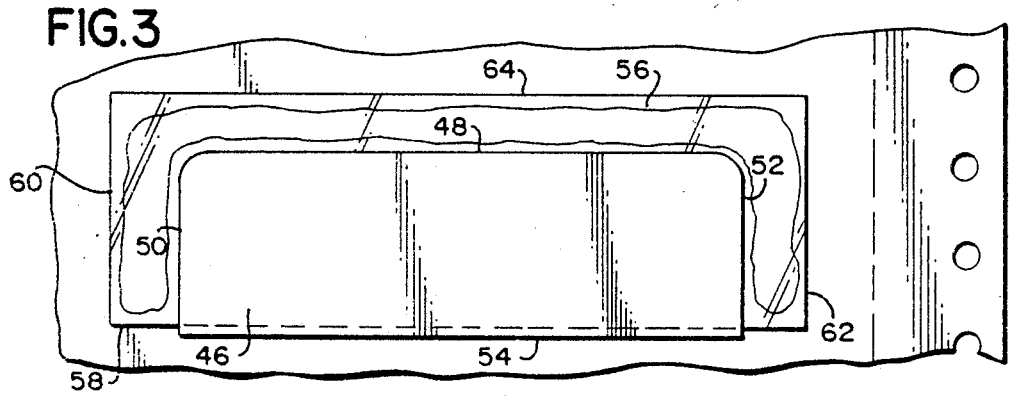
FIG. 3 is a partial detail of the web shown in FIG. 2 but wherein the window flap is shown in a closed position.

Referring now to FIGS. 1-3, a continuous web 10 incorporates a plurality of mailer type form blanks 12. The web has marginal edges 14, 16 and longitudinally arranged lines of feed holes 18, 20 located adjacent the marginal edges 14, 16, respectively. Longitudinally extending perforation lines 22, 24 define a pair of removable marginal strips 26, 28, respectively along either side of the web, in which lines of feed holes 18, 20 are located.

Individual, successive mailer blanks are defined by longitudinally spaced, transverse perforation lines 30, 32. Within each mailer blank in accordance with a fist exemplary embodiment of the invention, a transverse fold line 34, which may comprise a perforation line similar to marginal lines 22, 24, separates the mailer blank into a front envelope panel 36 and a rear envelope panel 38. The envelope panels also have an exterior surface 40 and an interior surface 42.

A window 44 is die cut in the front envelope panel 36, thereby forming a window flap portion 46 including edges 48,50 and 52 and a fourth, non-cut edge 54 about which the window flap portion 46 may fold between open (FIG. 2) and closed (FIGS. 1 and 3) positions. The window itself is defined by corresponding edges 48', 50', 52', as well as edge 54 as best seen in FIG. 2.

A clear film window patch 56 is adhesively secured over the window 44 by, for example, cold glue adhesive, shown at 57. More specifically, the patch, preferably rectangular in shape, has four peripheral edges 58, 60, 62 and 64. The first three patch edges 58, 60 and 62 overlap the three window edges 48', 50' and 52', while the fourth patch edge 64 lies adjacent the fourth window flap edge 54, as best seen in FIGS. 1 and 3.

The above described arrangement permits the window flap portion 46 to be folded between a printing or open position (FIG. 2), and a closed position (FIGS. 1 and 3), about the edge 54, which serves as an integral hinge. In the open position (FIG. 2), the interior surface 42 of the mailer blank, as well as the exterior surface of the window flap portion 46 may be printed together in a single printing operation. The printing step may be carried out before or after the patch 56 is applied over the window. It is, of course, advantageous to print the form prior to the application of the clear film patch since this permits additional areas of the blank to be printed. Any printing underlying a subsequently applied patch will, of course, be visible since the patch is transparent. In addition, since the transparent patch 56 is adhered to the interior panel surface 42, the transparent patch prevents the window flap portion 46 from passing through the window 44 when the flap is returned to a closed position.

Additional transverse lines of weakening 66, 68 are located adjacent the transverse lines 30, 32, respectively, thereby forming removable strips 66', 68' which facilitate opening of the envelope, as will be explained below.

Referring now specifically to FIG. 2, adhesive lines 70, 72 and 74 extend about the periphery of the interior surface 42 of the rear envelope panel 38. More specifically, adhesive lines 70 and 72 are applied adjacent the marginal lines of perforations 22, 24 and within the marginal strips 26, 28. The third adhesive line 74 extends laterally across the web, between the transverse lines of weakening 30 and 66. The adhesive may be of any suitable kind, but is preferably of the heat seal type.

As already noted, the above described form is designed to be printed in a non-impact printer, with variable information being applied to the interior surface 42 of one or both panels 36, 38 as well as to the exterior surface of label portion 46, folded to its open position shown in FIG. 2.

After printing, the envelope assembly may be removed from the web by tearing along transverse lines 30, 32.

In the event additional variable information is to be added to the mailer by the purchaser of the mailers, the continuous web may be folded in the conventional zigzag or accordion fashion, and shipped to the customer. After the second printing operation, the blank is folded about transverse line 34, and sealed about glue lines 70, 72 and 74.

In order to open the envelope, the recipient of the mailer can remove the marginal strips 26, 28, as well as transversely arranged strips 66' and 68' to thereby separate the front and rear panels 36, 38.

It is to be understood that other configurations for the mailer described above are within the scope of this invention. For example, the mailer blank may include a conventional closure flap, may or may not incorporate marginal feed strips with or without feed holes, etc., and may have fold lines arranged longitudinally rather than transversely of the continuous web.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A continuous business form assembly comprising a continuous web incorporating a plurality of business forms, the business forms each having a window flap portion and a non-window, remainder portion, the form having an exterior surface and an opposite, interior surface, the window flap portion having a first face defined on the web exterior surface and a second face defined on the web interior surface, the window first face and second face thereby being defined on the opposite exterior and interior surfaces of the form, wherein the window flap portion is partially cut from the form to thereby form a window at least partially defined by one edge providing a fold line about which the window flap portion is foldable to a printing position in which the window flap first face is exposed with the interior surface of the form, for simultaneous, printing of the window flap first face and the interior surface of the form, and wherein the window flap portion is foldable along the fold line, after printing, to a closed label position in which the window flap first face is returned to exposure with the exterior surface of the form, and acts as a label for the business form, and wherein each window is substantially covered by a transparent patch adhered only to said interior surface of the form, said patch defined by four edges, a first of which is located substantially adjacent said fold line.

2. A continuous business form assembly as in claim 1 in which the window flap portion comprises an address portion for the printing of address information during the simultaneous printing of the form interior surface.

3. A continuous business form assembly as in claim 1 wherein said transparent patch is adhered to said remainder portion of said web surface only along second, third and fourth edges of said patch.

4. A continuous business form assembly as in claim 1 wherein each business form includes an envelope front panel and envelope rear panel and wherein said window flap portion is provided in the envelope front panel, and said fold line extends substantially parallel to transverse lines of perforations extending across the web in a direction substantially transverse to the direction of movement of said web.

5. A continuous business form assembly as in claim 1 wherein said window flap portion lies behind said patch so that said window flap portion is free to move from said printing position to said label position and vice versa, but said window flap portion is prevented from moving through said window by said patch.

6. A continuous business form assembly as in claim 1 wherein said plurality of business forms are longitudinally separated by transversely extending lines of perforations, and said web further includes at least one marginal feed strip extending longitudinally along at least one side of said web.

7. A continuous business form assembly as in claim 6 wherein said at least one marginal feed strip is removable.

8. A business form assembly wherein a continuous, elongated web is divided into a plurality of business forms by a plurality of longitudinally spaced, transverse lines of perforations; each form comprising an envelope front panel and an envelope rear panel, said panels separated by a first fold line; said front envelope panel formed with a window cut from said front envelope panel along three edges to form a flap portion foldable about a fourth edge of said window; and a transparent patch adhesively secured over said window such that three edges of said patch overlie said three window edges, and such that a fourth edge of said patch lies adjacent but does not overlap said fourth edge of said window.

9. A business form assembly as defined in claim 8 and wherein said first fold line extends substantially parallel to said transverse lines of perforations.

10. A business form assembly as defined in claim 9 wherein said fourth edge of said window extends substantially parallel to said transverse lines of perforations.

11. A business form assembly as defined in claim 8 wherein said flap portion is foldable about said fourth edge of said window between open and closed positions.

12. A business form assembly as defined in claim 8 wherein said patch is secured over said window by cold glue adhesive.

13. A business form assembly as defined in claim 8 wherein said envelope front panel has an exterior surface and an interior surface, and wherein said patch is applied to the interior surface of the front panel.

14. A business form assembly as defined in claim 13 wherein said one of said front and rear panels is provided with adhesive for securing said front and rear panels together about three peripheral edges thereof.

15. A business form mailer comprising:

a front envelope panel having an exterior and interior surface;

a rear envelope panel having an exterior and interior surface;

said front and rear panels being secured along at least three peripheral edges of said front and rear panels;

a window flap portion partially cut from said front envelope panel to form a window, one edge of said window comprising a fold line for said window flap portion;

a clear film patch applied to the interior surface of said front panel overlying said window, but not overlying said fold line; and wherein said window flap portion, aside from said one edge, is otherwise unsecured to said front envelope panel.

16. The business form mailer of claim 15 wherein removable strips are provided about the entire periphery of said mailer.

17. The business form mailer of claim 15 wherein front and rear panels are formed from a single sheet.

18. The business form mailer of claim 15 wherein at least one of said front and rear panels and said window flap portion are preprinted.

19. The business form mailer of claim 15 wherein said patch comprises a clear film.

20. The business form mailer of claim 18 wherein said patch comprises a clear film.

* * * * *